United States Patent [19]

Hasson et al.

[11] Patent Number: 4,973,886

[45] Date of Patent: Nov. 27, 1990

[54] FOUR LAMP FLUORESCENT BALLAST MEANS

[75] Inventors: Sol Hasson, Skokie; Frank J. Gonzales, Morton Grove, both of Ill.

[73] Assignee: North American Philips Corporation, New York, N.Y.

[21] Appl. No.: 393,331

[22] Filed: Aug. 14, 1989

[51] Int. Cl.[5] ..... H05B 41/00; H05B 41/16

[52] U.S. Cl. ..... 315/324; 315/161; 315/250; 361/377

[58] Field of Search ..... 315/161, 250, 254, 255, 315/256, 257, 258, 324; 361/377

[56] References Cited

U.S. PATENT DOCUMENTS 4,766,353 8/1988 Burgess ..... 315/324

4,916,363 4/1990 Burton et al. ..... 361/377 X

*Primary Examiner*—Mis: David

*Attorney, Agent, or Firm*—Robert T. Mayer

[57] ABSTRACT

A four way rapid start fluorescent fixture with two ballast means each of which ballast means has three pairs of lamp wires emanating from one of its ends.

6 Claims, 2 Drawing Sheets

FOUR LAMP FLUORESCENT BALLAST MEANS

This is an invention in the lighting art. More particularly, it involves an improved ballast means for a four lamp fluorescent fixture.

This invention is related to that disclosed in our concurrently filed patent application Ser. No. 393,342 entitled "Four Lamp Fluorescent Wiring Arrangement" assigned to the same assignee as this application. The disclosure therein is incorporated by reference herein.

One of the objects of the invention is to improve four lamp rapid start fluorescent fixtures.

An advantage of the invention is that a considerable amount of wire is saved in such a four lamp rapid start fluorescent fixture over earlier such fixtures.

Another advantage of the invention is that it lends itself to the use of fixed connectors in association with lamp ballasts.

One of the features of the invention is to use ballast means with three pairs of lamp wires emanating from one of its ends.

In carrying out the invention there is provided a four lamp rapid start fluorescent fixture with two ballast means. Each lamp is a straight elongated tube having two ends with filaments at each end. Each ballast means is associated with a pair of lamps and has two ends. Each ballast means includes three pairs of lamp wires for connection to lamp filaments. The improvement is that all three pairs of lamp wires of each ballast means emanate from their associated ballast means from the same end thereof.

Other objects, features and advantages of the invention will be apparent from the following description and appended claims when considered in conjunction with the accompanying drawing in which:

Figure 1:
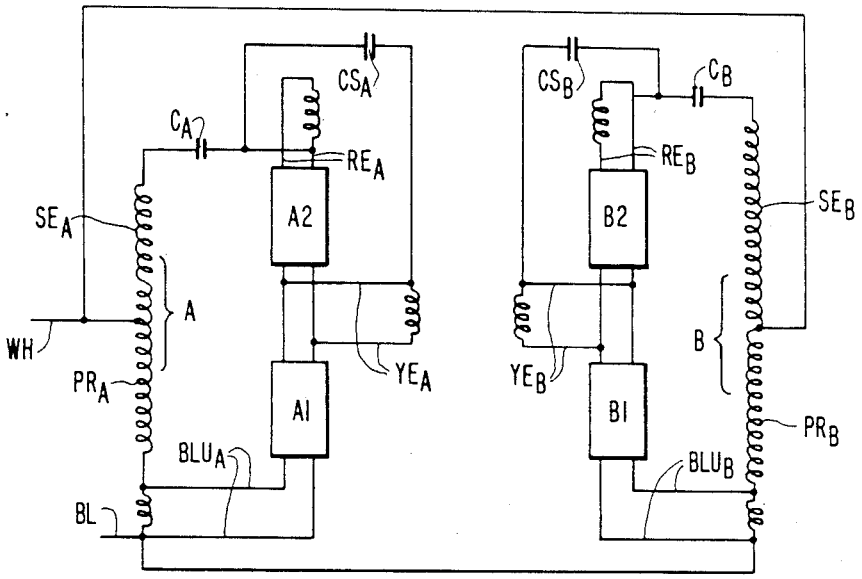
FIG. 1 PRIOR ART
FIG. 1 is a wiring diagram of a previous type four lamp rapid start fluorescent unit.

Shown in FIG. 1 are two pairs of fluorescent lamps A1 and A2 and B1 and B2. Each lamp is a straight elongate tube with filaments at each of its ends. Each pair of lamps has its own respective ballast means A and B. Each ballast means includes a primary winding $PR_A$, $PR_B$ and an associated secondary winding $SE_A$, $SE_B$. Each primary winding is connected across a source of voltage provided across line BL and its ground return WH. Operating voltage for each of the pairs of fluorescent tubes is provided along red lines $RE_A$, $RE_B$. Voltage for lower filaments (as shown in FIG. 1) of each pair of tubes is provided by blue lines $BLU_A$ and $BLU_B$. The adjoining electrodes of each pair of tubes is provided with voltage along yellow lines $YE_A$ and $YE_B$. Capacitors $CS_A$ and $CS_B$ serve as the well known starting capacitors while capacitors $C_A$ and $C_B$ contribute to the ballast impedance. All of the foregoing is by way of background information, it being well known to those skilled in the fluorescent lighting art.

Figure 2:
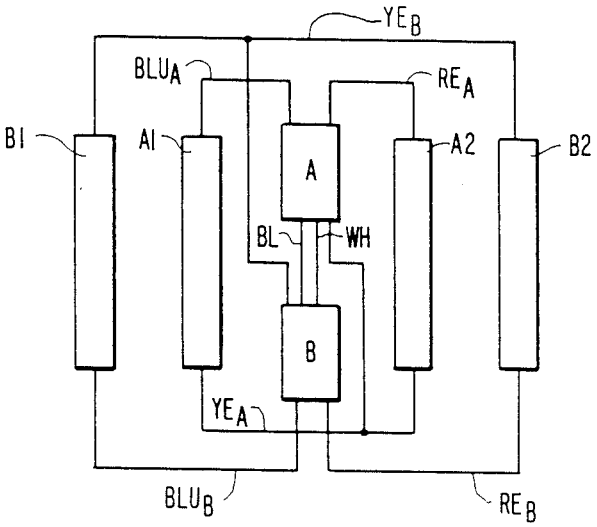
FIG. 2 PRIOR ART
FIG. 2 is the typical physical layout arrangement for the lamp unit of FIG. 1.

Shown in FIG. 2 is a typical physical layout for the circuit shown in FIG. 1. Appearing therein are the power supply lines BL and WH. All the rest of the lamp wires shown are shown as single wires although it is to be understood that each in fact represents a pair of lamp wires. As can be seen ballast A is connected to lamp A1 by blue wires $BLU_A$ and is connected to lamp A2 by red wires $RE_A$. Both the blue wires and the red wires emanate from one end of ballast A. Emanating from the other end of ballast A are yellow wire $YE_A$. These are connected to the other ends of fluorescent tubes A1 and A2. Likewise, ballast B has blue wires $BLU_B$ and red wires $RE_B$ emanating from one of its ends and connected to lamps B1 and B2, respectively. Emanating from the other end of ballast B are yellow wires $YE_B$ which are connected to the other ends of lamps B1 and B2. This has been a standard connecting practice in the fluorescent lamp business for approximately 35 years.

Figure 3:
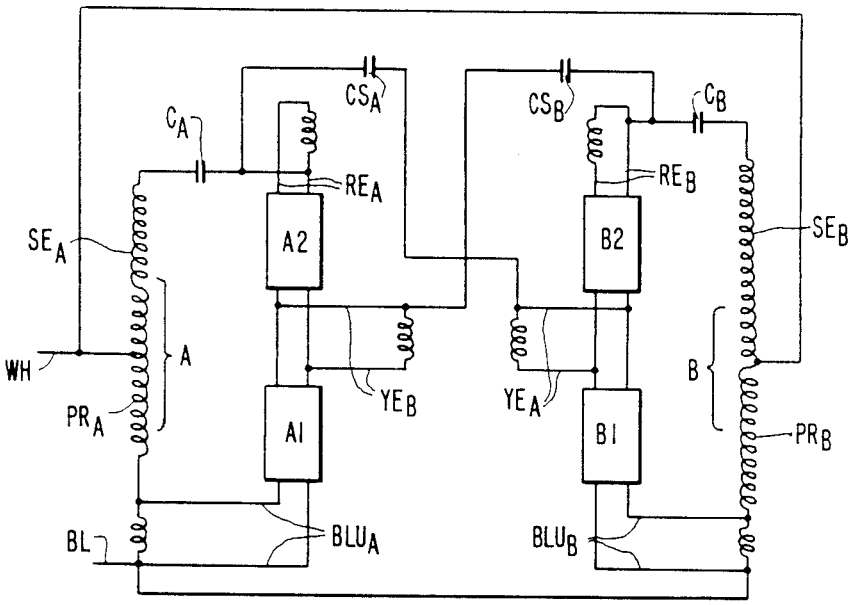
FIG. 3 is a wiring diagram of the improved four lamp rapid start fluorescent unit.
Figure 4:
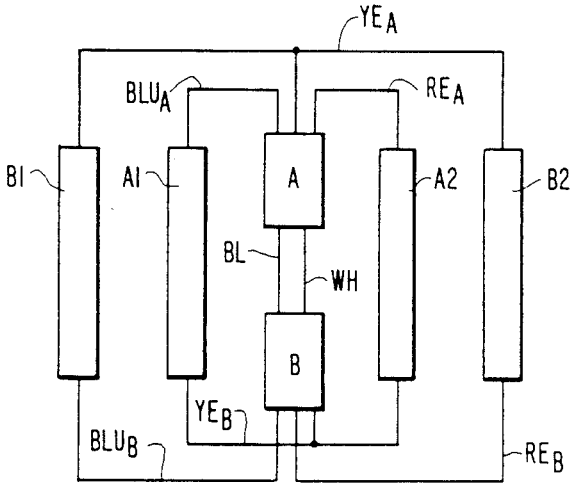
FIG. 4 is the improved physical layout arrangement according to the invention.

All of the objects, features and advantages of the invention will be clear from a comparison of FIGS. 3 and 4 with FIGS. 1 and 2. In this respect it will be seen that yellow wires $YE_A$ from the heater coils of ballast A are not connected to filaments of tubes A1 and A2 but rather are connected to filaments of tubes B1 and B2. Likewise yellow wires $YE_B$ from ballast means B are connected to filaments of tubes A1 and A2. From FIG. 4 it can also be seen that the yellow wires now emanate from their respective ballast means through the same sides as the blue and red wires. This is in contrast to the manner in which they used to emanate from their respective ballast means, that is at the ends opposite from which the blue and red wires emanated.

By the arrangement of this invention each pair of yellow wires in a four foot fluorescent fixture has been shortened from 36" long to 12 inches.

It should be apparent that various modifications of the above will be evident to those skilled in the art and that the arrangement described herein is for illustrative purposes and is not to be considered restrictive.

What is claimed is:

1. A four lamp rapid start fluorescent fixture with two ballast means, each lamp being a straight elongated tube having two ends with filaments at each end, each ballast means being primarily associated with a pair of lamps and having two ends, each ballast means having three pairs of lamp wires for connection to lamp filaments, wherein the improvement is that all three pairs of lamp wires emanate from their associated ballast means from the same end thereof.

2. A four lamp rapid start fluorescent fixture as claimed in claim 1, wherein said three pairs of lamp wires of each ballast means are connected to lamp filaments.

3. A four lamp rapid start fluorescent fixture as claimed in claim 1, wherein a power connection and a ground connection are made to the end of each ballast means opposite said same end.

4. A four lamp rapid start fluorescent fixture as claimed in claim 3, wherein said lamps are disposed substantially parallel to each other with said ballast means between said lamps.

5. A four lamp rapid start fluorescent fixture as claimed in claim 4, wherein said ballast means are disposed one next to the other between said lamps.

6. A four lamp rapid start fluorescent fixture as claimed in claim 5, wherein one pair of said lamps is disposed inside the other pair.

* * * * *